US005306463A

United States Patent [19]

Horimura

[11] Patent Number: 5,306,463

[45] Date of Patent: Apr. 26, 1994

[54] PROCESS FOR PRODUCING STRUCTURAL MEMBER OF AMORPHOUS ALLOY

[75] Inventor: Hiroyuki Horimura, Saitama, Japan

[73] Assignee: Honda Giken Kogyo Kabushiki Kaisha, Tokyo, Japan

[21] Appl. No.: 687,825

[22] Filed: Apr. 19, 1991

[30] Foreign Application Priority Data

Apr. 19, 1990 [JP] Japan ..... 2-104142

[51] Int. Cl.[5] ..... B22F 1/00

[52] U.S. Cl. ..... 419/44; 419/50; 419/55; 419/38

[58] Field of Search ..... 419/8, 44, 50, 55, 38; 75/243, 122

[56] References Cited

U.S. PATENT DOCUMENTS

| | | | |
|---|---|---|---|
| 4,092,157 | 7/1978 | Reid | 419/21 |
| 4,377,622 | 3/1983 | Lieberman | 419/4 |
| 4,594,104 | 6/1986 | Reybould | 75/243 |
| 4,698,269 | 10/1987 | Narusch et al. | 428/552 |
| 4,892,579 | 1/1990 | Hazelton | 419/46 |
| 4,921,410 | 5/1990 | Kawamura et al. | 419/8 |

*Primary Examiner*—Donald P. Walsh
*Assistant Examiner*—Anthony R. Chi
*Attorney, Agent, or Firm*—Lyon & Lyon

[57] ABSTRACT

A process for producing a structural member of an amorphous alloy, which includes the steps of subjecting a material formed from an amorphous alloy having a glass transition temperature Tg and a crystallization temperature Tx, which is higher than the glass transition temperature Tg, to a thermal treatment in which the material is kept at a heating temperature equal to or lower than the glass transition temperature Tg, thereby generating a structure relaxation phenomenon in the material, and subjecting the material to a hot plastic working while setting the hot working start temperature of the green compact at a level equal to or lower than the crystallization temperature Tx. In this process, the workability of the material can be improved to produce a high strength amorphous alloy structural member that has an increased volume fraction of an amorphous phase. Furthermore the generation of any defect due to gas inclusion is suppressed.

4 Claims, 6 Drawing Sheets

PROCESS FOR PRODUCING STRUCTURAL MEMBER OF AMORPHOUS ALLOY

BACKGROUND OF THE INVENTION

1. Field of the Invention

The field of the present invention is processes for producing a structural member of an amorphous alloy, and more particularly, processes for producing such structural member from a material formed of an amorphous alloy having a glass transition temperature Tg and a crystallization temperature Tx higher than the glass transition temperature Tg.

2. Description of the Prior Art

Conventionally, to produce a member of such type, a procedure is employed which comprises forming a green compact from an amorphous alloy powder, heating the green compact, and subjecting the green compact to a hot plastic working. The hot working start temperature of the green compact is set at a level equal to or lower than the crystallization temperature.

The hot plastic working of the green compact utilizes a plasticization accompanied by an endothermic phenomenon which the amorphous alloy exhibits at a temperature range exceeding the glass transition temperature Tg. Therefore, in order to improve the workability of the green compact to produce a structural member having a high volume fraction Vf of an amorphous phase, it is necessary to permit such endothermic phenomenon to occur sufficiently.

However, the amorphous alloy has an instable nature after production, and, therefore, when heated, it generates a structure relaxation phenomenon accompanied by an exothermic phenomenon due to a rearrangement of atoms. The prior art process, therefore has a problem that because the structure relaxation phenomenon is, of course, generated even at a green compact working step, the degree of plasticization of the green compact is low and the elongation of the green compact is small due to endothermic and exothermic phenomenons being generated simultaneously.

SUMMARY OF THE INVENTION

Accordingly, it is an object of the present invention to provide a producing process of the type described above, wherein the workability of a material can be improved by subjecting an amorphous alloy, and thus the material, to a thermal treatment to permit the generation of a structure relaxation phenomenon therein, prior to hot plastic working, thereby producing a structural member having a high volume fraction of an amorphous phase.

To achieve the above object, in a first aspect of the present invention, there is provided a process for producing a structural member of an amorphous alloy, comprising the steps of forming a material formed from an amorphous alloy having a glass transition temperature Tg and a crystallization temperature Tx that is higher than the glass transition temperature Tg: subjecting the material to a thermal treatment in which the material is kept at a heating temperature equal to or lower than the glass transition temperature Tg, thereby permitting a structure relaxation phenomenon to occur in the material; and subjecting the material to a hot plastic working while setting the temperature of the material at the time of starting the working operation to a level equal to or lower than the crystallization temperature Tx.

With the first aspect, the generation of the structure relaxation phenomenon of the material can be suppressed in the hot plastic working step, thereby increasing the degree of plasticization of the material to ensure that the material has a sufficient elongation.

In addition, the material shrunks with generation of the structure relaxation phenomenon, and, therefore, gas contained in the material is expelled to the outside, thereby suppressing the generation of defects in the resulting structural member due to entrapped gas.

A second aspect of the present invention resides in a process for producing a structural member of an amorphous alloy, wherein during the thermal treatment step, the structure relaxation phenomenon is sustained until the material assumes a state similar to those provided when the material is heated to a temperature range between the glass transition temperature Tg and the crystallization temperature Tx.

With the second aspect, the structure relaxation phenomenon of the material can be substantially completed by the thermal treatment, thereby providing a further enhanced elongation of the material and further promoting the expelling of the gas.

The above and other objects, features and advantages of the invention will become apparent from the following description of the preferred embodiment, taken in conjunction with the accompanying drawings.

DESCRIPTION OF THE PREFERRED EMBODIMENT

Figure 1:
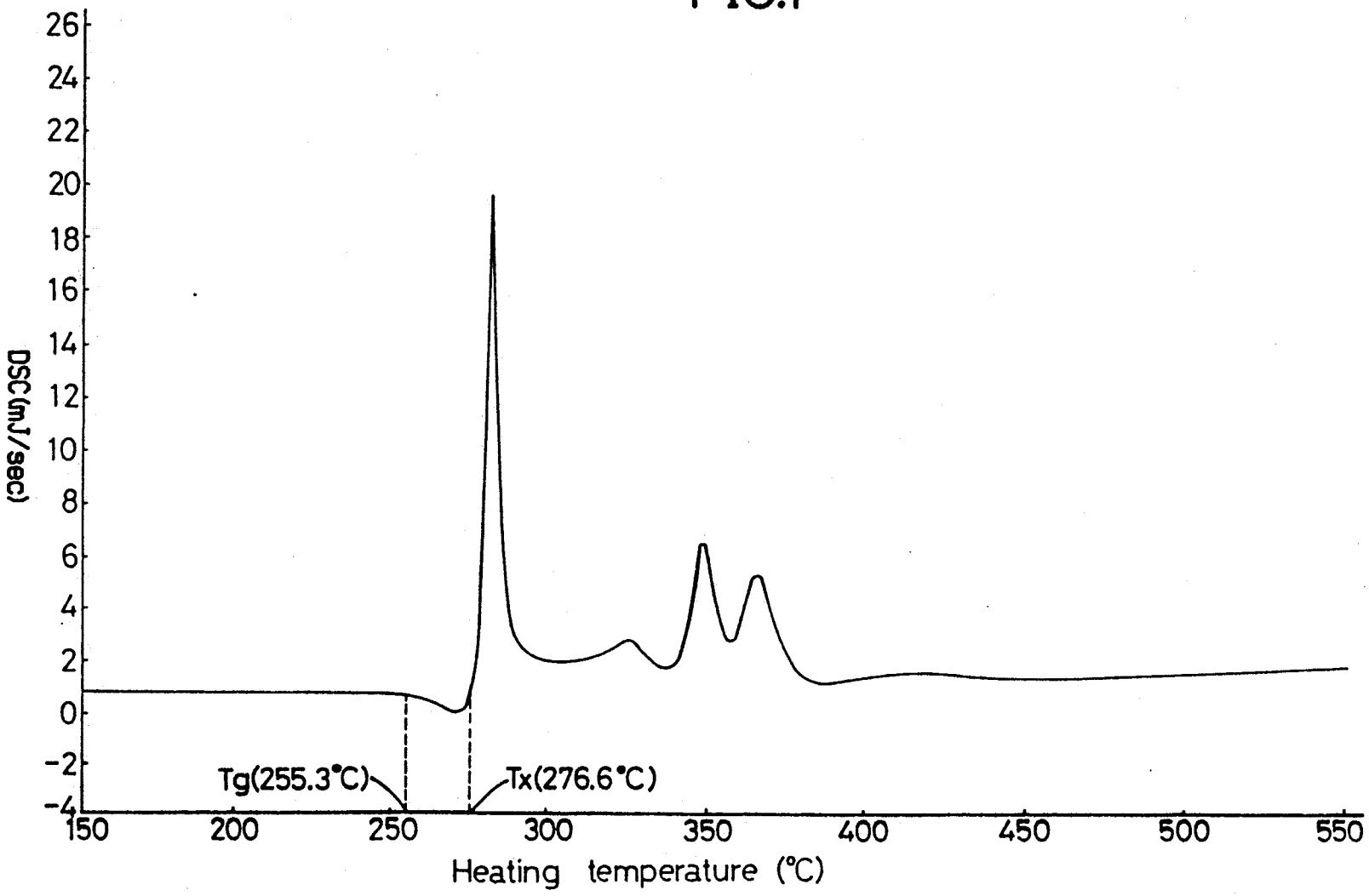
FIG. 1 is a thermogram of differential thermal analysis for an amorphous alloy.

FIG. 1 is a thermogram of differential thermal analysis for an $Al_{85}Ni_5Y_{10}$ alloy (the numerical value represents atomic %) which is an amorphous alloy. This alloy has a glass transition temperature Tg of 255.3° C. and a crystallization temperature Tx of 276.6° C. The $Al_{85}Ni_5Y_{10}$ alloy is produced by a high pressure gas atomizing process using an He gas and is in the form of a powder having a particle diameter of 22 μm or less and an amorphous phase volume fraction Vf of 100%.

In producing a structural member, the following steps are sequentially conducted: forming a green compact from the $Al_{85}Ni_5Y_{10}$ alloy powder, subjecting the green compact to a thermal treatment wherein the green compact is kept at a heating temperature equal to or lower than the glass transition temperature Tg, thereby permitting a structure relaxation phenomenon accompanied by an exothermic phenomenon to occur in the green compact, and then subjecting the green compact to a hot plastic working while setting the temperature of the green compact at the time of starting the working thereof to a level equal to or lower than the crystallization temperature Tx. During this hot plastic working step, the alloy powder is sintered.

In the forming step for providing the green compact, a standard green compact forming technique is utilized. Also, in the hot plastic working step, a standard technique such as a hot extrusion, a hot forging and the like is utilized.

In the thermal treatment step, a procedure is utilized which comprises placing the green compact into an electric furnace where it is kept in an inert gas atmosphere for a predetermined period of time at a predetermined heating temperature equal to or lower than the glass transition temperature Tg.

Figures 2A, 2B, 2C, 2D, 2E:
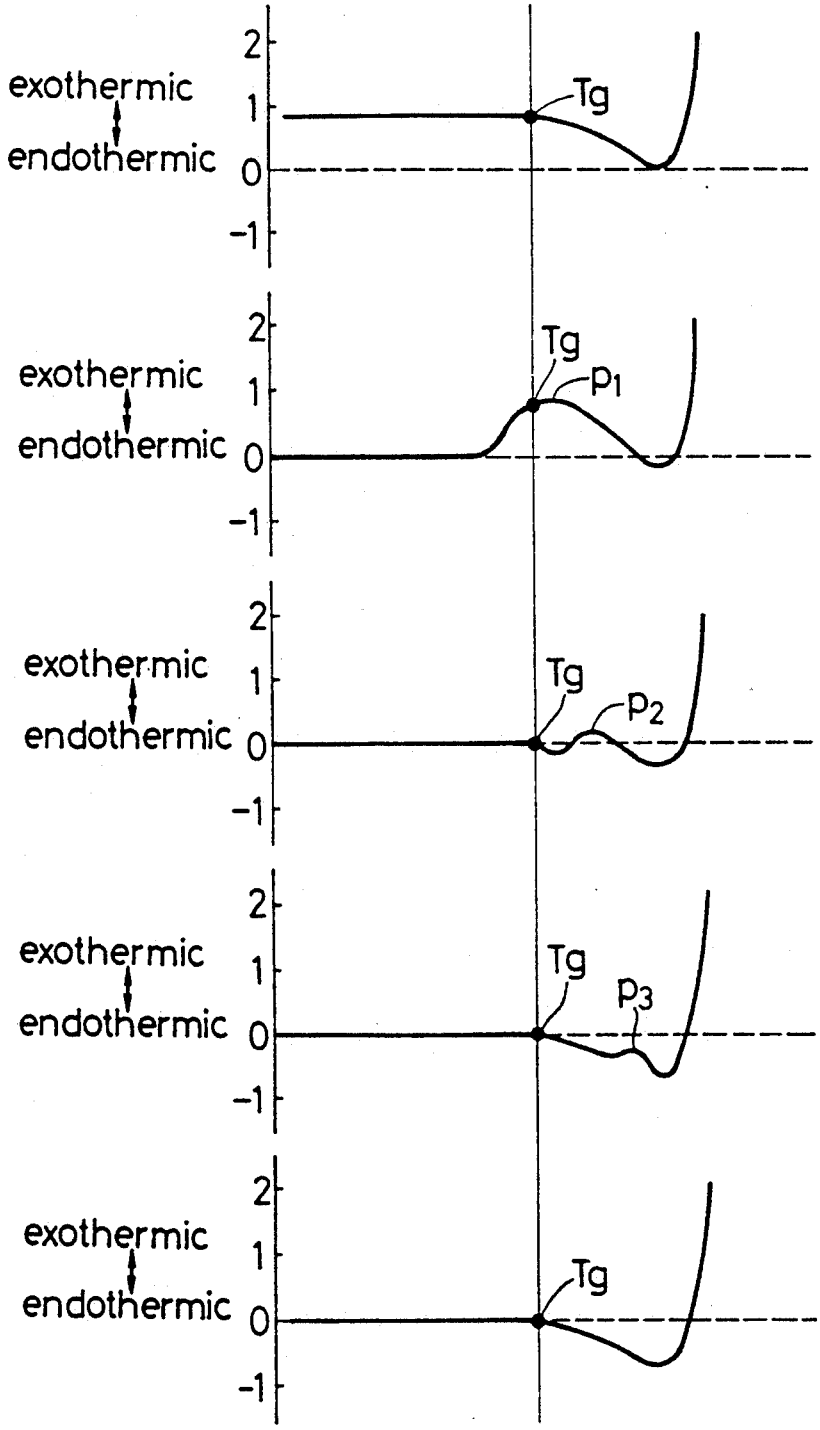
FIGS. 2*a* to 2*e* illustrate enlarged essential portions of thermograms of differential thermal analysis for various green compacts of an amorphous alloy, respectively.

FIGS. 2*a* to 2*e* illustrate enlarged essential portions of thermograms of differential thermal analysis for green compacts made of the $Al_{85}Ni_5Y_{10}$ alloy that have and have not been subjected to the thermal treatment, respectively. The temperature was raised at a rate of 20° C./min during this analysis. FIG. 2*a* corresponds to the thermally-untreated green compact, and FIGS. 2*b* to 2*e* correspond to a thermally treated green compacts. The conditions for thermal treatment were such that the green compact was kept at 240° C. for 5 minutes in FIG. 2*b*; at 240° C. for 30 minutes in FIG. 2*c*; at 240° C. for 60 minutes in FIG. 2*d*; and at 240° C. for 100 minutes in FIG. 2*e*.

With the thermally-untreated green compact of FIG. 2*a*, the is a large exotherm produced with the generation of an active structure-relaxation phenomenon due to a heating before the glass transition temperature Tg is reached. After exceeding the glass transition temperature Tg, however the exotherm is reduced with generation of an endothermic phenomenon.

With the thermally treated green compact in FIG. 2*b*, an exothermic phenomenon is observed immediately before the glass transition temperature Tg is reached due to generation of a structure relaxation phenomenon provided by atoms which have not been rearranged, and a peak $p_1$ due to an exothermic phenomenon appears immediately after exceeding the glass transition temperature Tg. In this case, however, the total exotherm is less than in the case where no thermal treatment was conducted.

With the thermally treated green compacts of FIGS. 2*c* and 2*d*, the degree of the thermal treatment was higher than for the thermally treated green compact of FIG. 2*b*. As a result, the structure relaxation phenomenon was less generated pronounced in the green compact of FIG. 2*a*, with the result that peaks $p_2$ and $p_3$ due to the exothermic phenomenon are lower in height after exceeding the glass transition temperature Tg, and the total exotherm is less for these components than that for the thermally treated green compact of FIG. 2*b*.

With the thermally treated green compact of FIG. 2*e*, the structure relaxation phenomenon has substantially been completed by the thermal treatment, and, hence, little exothermic phenomenon occurs. Therefore, the endothermic phenomenon is generated immediately after exceeding the glass transition temperature Tg. This is due to the time of thermal treatment having been extended and the structure relaxation phenomenon having been sustained until the green compact exhibited properties equivalent to those provided when it is heated in a temperature range between the glass transition temperature Tg and the crystallization temperature Tx.

Figure 3:
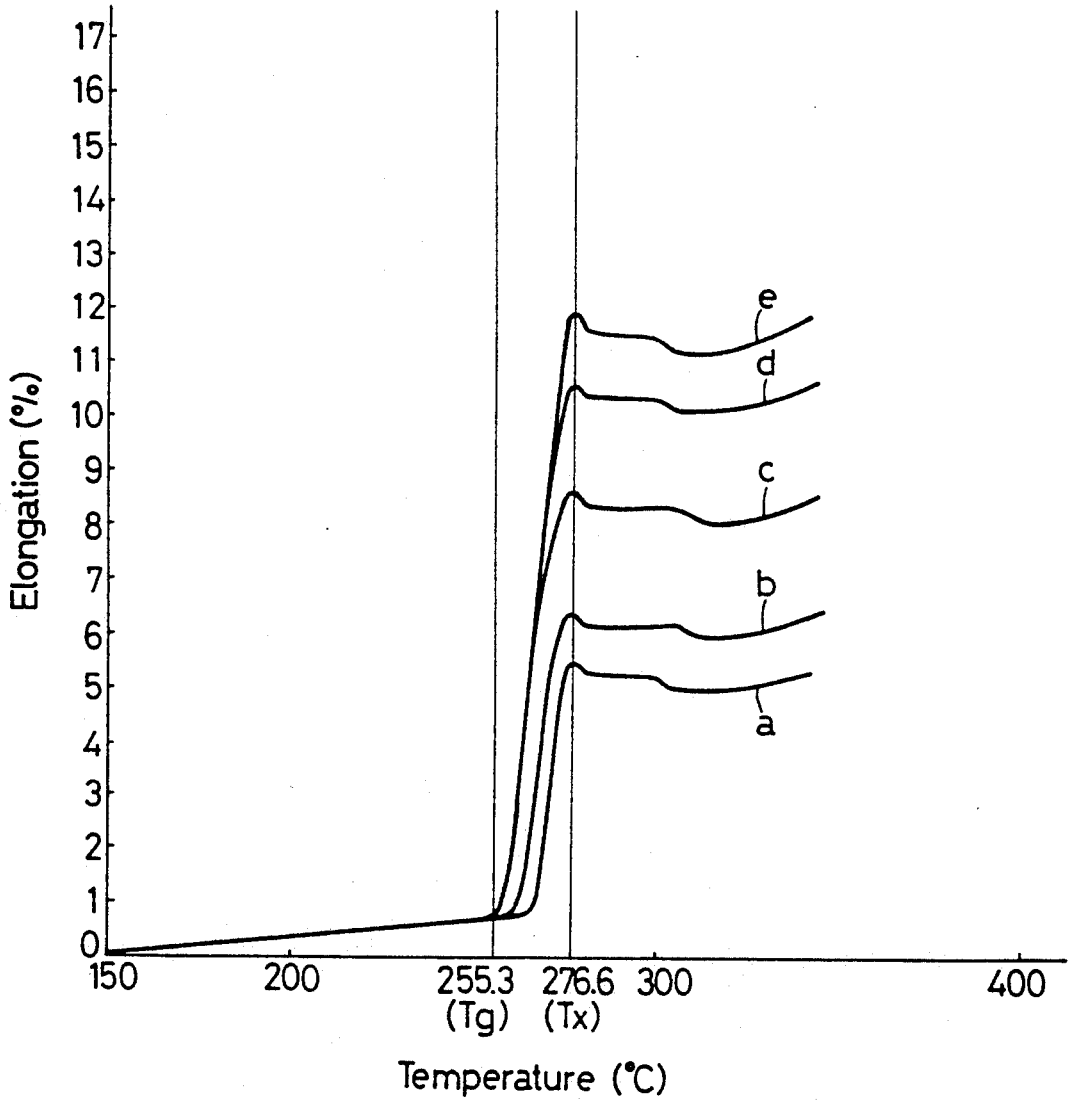
FIG. 3 is a graph illustrating a relationship between the temperature and elongation for the various amorphous alloy green compacts.

FIG. 3 illustrates the results of elongation measurements for green compacts of the $Al_{85}Ni_5Y_{10}$ alloy under a given load while the temperature was raised at a rate of 20° C./min. Lines a to e in FIG. 3 correspond to the green compacts shown in FIGS. 2*a* to 2*e*, respectively.

With the thermally-untreated green compact indicated by the line a in FIG. 3, the elongation is small because the structure relaxation phenomenon exists even after exceeding the glass transition temperature Tg. Furthermore, the temperature at completion of the structure relaxation phenomenon is close to the crystallization temperature Tx.

With the thermally treated green compact indicated by the line b in FIG. 3, the elongation is larger than that of the green compact indicated by the line a in FIG. 3, because although the structure relaxation phenomenon still exists even after exceeding the glass transition temperature Tg, the temperature at completion of the structure relaxation phenomenon is closer to the glass transition temperature Tg than in the case where no thermal treatment was conducted.

With the thermally treated green compacts indicated by the lines c to e in FIG. 3, the temperatures at the time of completion of the structure relaxation phenomenon approximate the glass transition temperature Tg. The degree of such approximation increases in sequence from line c to line e. Therefore their elongations are increased correspondingly.

If the green compact of the $Al_{85}Ni_5Y_{10}$ alloy is subjected to a thermal treatment in the aforementioned manner, the generation of the structure relaxation phenomenon can be suppressed or avoided during the hot plastic working step, thereby increasing the degree of plasticization of the green compact to ensure that the green compact has sufficient elongation.

The green compact shrunks with generation of the structure relaxation phenomenon, and, hence, gas contained in the green compact is expelled to the outside, thereby suppressing the generation of any defect in the structural member due to the gas.

The use of a casting as a material will be considered below.

A molten metal having a composition of $Mg_{65}Cu_{25}Y_{10}$ (wherein the numerical values represents atomic %) was prepared by high-frequency melting under a vacuum of $2\times10^4$ torr. The molten metal was poured through an inlet of a quartz nozzle having a diameter of 0.3 mm into a rotating mold of Cu, where it was quenched and solidified under a centrifugal force to produce a ring-like casting having an outside diameter of 70 mm, a thickness of 10 mm and a length of 5 mm.

Figure 5:
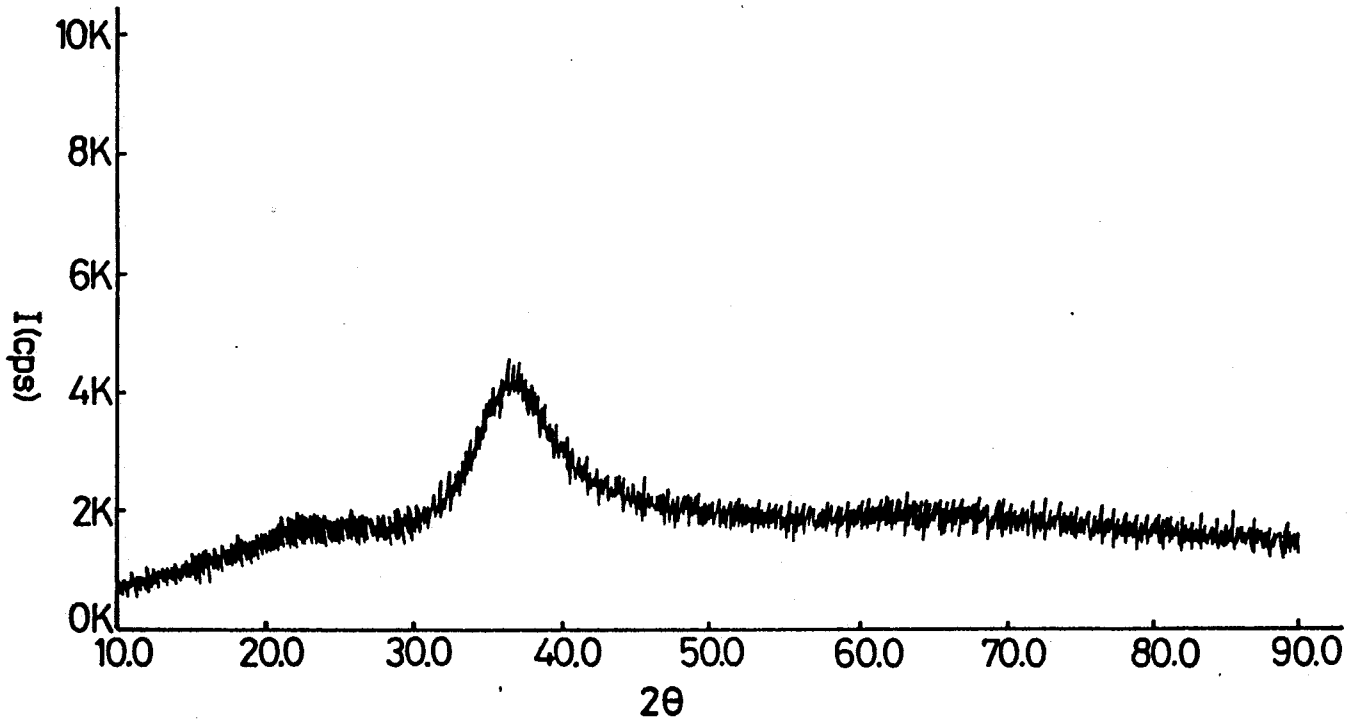
FIG. 5 is an X-ray diffraction diagram of another amorphous alloy.

FIG. 5 shows an X-ray diffraction diagram of the ring-like casting. The diffraction diagram contains a halo pattern peculiar to an amorphous material. It can be seen, therefore, from the halo pattern that the ring-like casting formed from the alloy of $Mg_{65}Cu_{25}Y_{10}$ has an amorphous phase volume fraction Vf of 100%.

Figure 6:
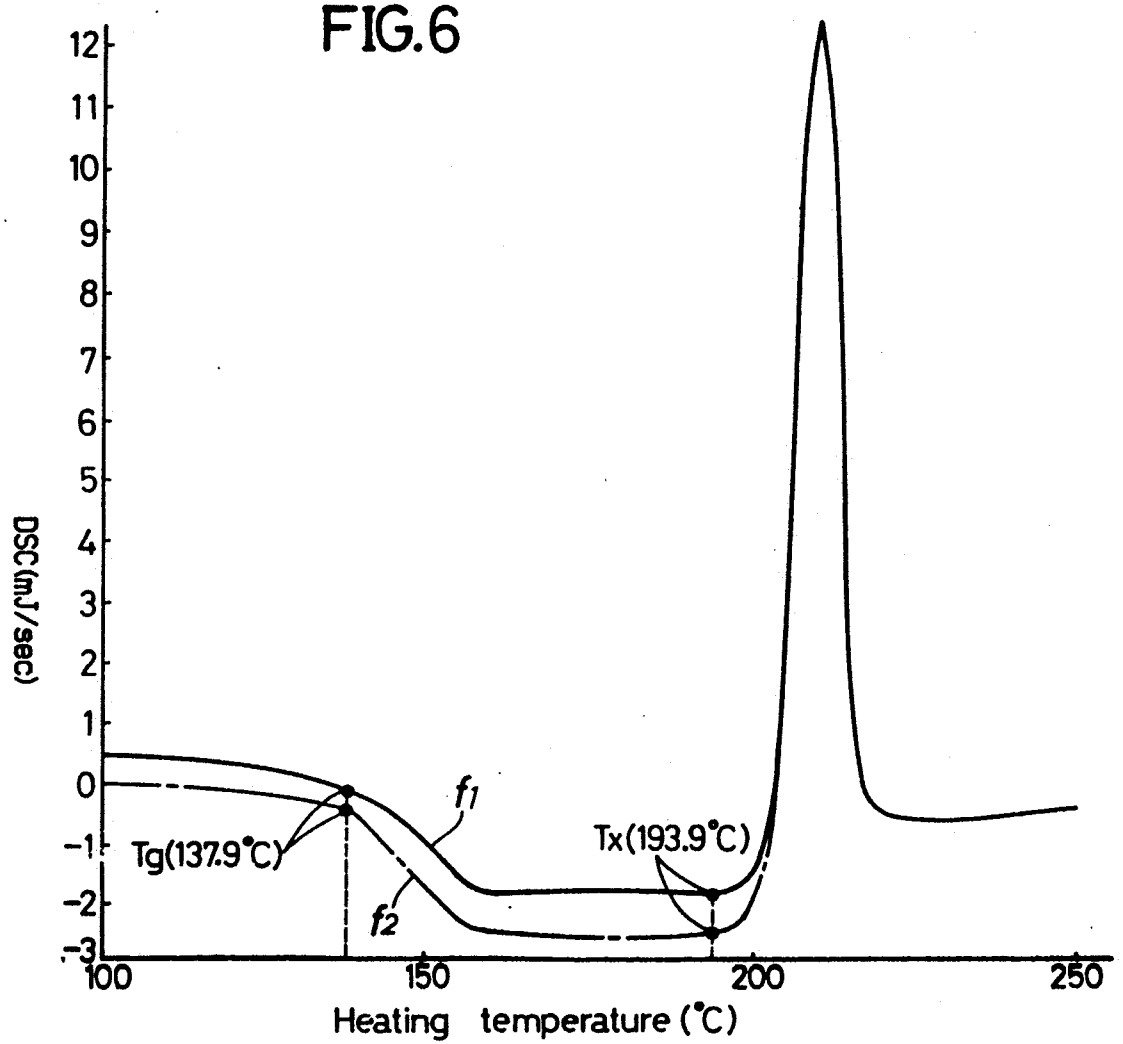
FIG. 6 is a thermogram of differential thermal analysis for the amorphous alloy.

A line $f_1$ in FIG. 6 indicates the result of a differential thermal analysis for the ring-like casting, wherein the ring-like casting has a glass transition temperature Tg of 137.9° C. and a crystallization temperature Tx of 193.9° C.

Then, the ring-like casting was shattered into cubic casting pieces each having a size of about 5 cubic millimeter.

The cubic casting pieces were used as a material, and the material was subjected to a thermal treatment wherein it was kept at 130° C. for 60 minutes.

The material was then placed into a mold, where it was pressed with a pressing force of 40 kg f/mm$^2$ and heated under pressure from room temperature to about 180° C. at a rate of 20° C./min for a differential thermal analysis.

Line $f_2$ in FIG. 6 illustrates the result of such differential thermal analysis. It can be seen from the line $f_2$ that in the material subjected to the thermal treatment as described above, the structure relaxation phenomenon has substantially been completed. Hence the material immediately produces an endothermic phenomenon at a temperature near the glass transition temperature Tg and is thus plasticized.

For comparison, a material which was not subjected to the above thermal treatment was subjected to a differential thermal analysis similar to that described above and as a result, it was confirmed that the material was not plasticized unless the temperature exceeded 160° C. This is because the plasticization is retarded in accordance with the time required for the structure relaxation phenomenon to be completed.

When the present invention is carried out using a material formed of an amorphous alloy which has a large difference between a glass transition temperature Tg and a crystallization temperature Tx as does the alloy of $Mg_{65}Cu_{25}Y_{10}$, it is possible to increase the degree of freedom in setting factors such as the working rate, the elongation and the working time.

On the other hand, with a material made of an amorphous alloy having a difference less than 30° C. between the glass transition temperature Tg and the crystallization temperature Tx, it cannot be worked under normal hot plastic working conditions. According to the present invention, however, it is possible to shorten the time required for plasticization, and, therefore, the hot plastic working can be conducted using such material. It should be noted that the amorphous alloys which may be used include an $Mg_{76}Ni_{10}Ce_{10}Cr_4$ alloy (in which the numerical values represent atomic %, and which has a glass transition temperature Tg of 184.6° C. and a crystallization temperature Tx of 208.9° C.), $Mg_{82}Ni_8Y_{10}$ alloy (in which the numerical values represents atomic %, and which has a glass transition temperature Tg of 170.4° C. and a crystallization temperature Tx of 197.2° C.) and the like.

EXAMPLES

The $Al_{85}Ni_5Y_{10}$ alloy powder was placed into a can having a thickness of 10 mm and made of an aluminum alloy (AA specification 6061 material) and then subjected to a green compact formation under a forming pressure 160 kg f/mm$^2$. The can was then subjected to a machining operation to produce a billet comprised of a green compact and the can.

Figure 4:
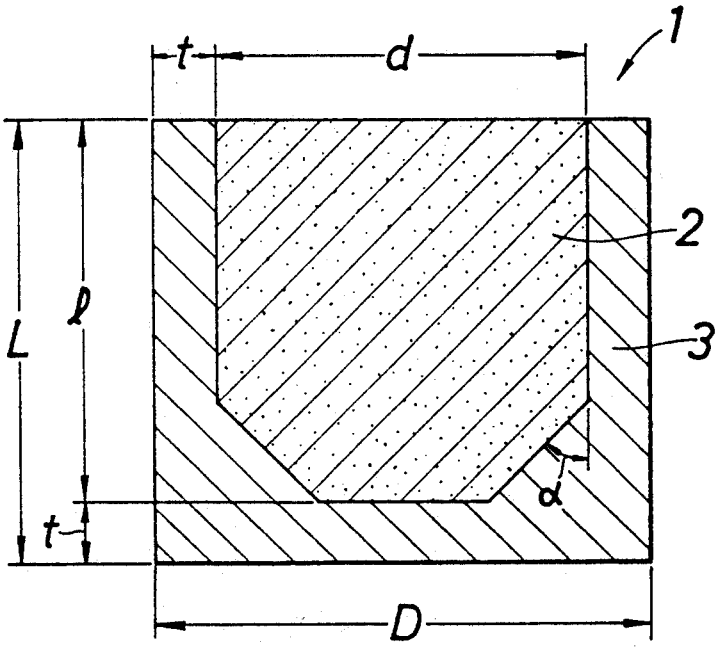
FIG. 4 is a sectional view of a billet.

FIG. 4 illustrates a billet 1, wherein a green compact 2 has a diameter d of 58 mm and a length l of 60 mm and includes a truncated-conical tip end located in a can 3. The inclined angle $\alpha$ of the truncated-conical portion with respect to the remaining rounded portion of the green compact is 45°. The can 3 has an outer diameter D of 78 mm and a length of L of 70 mm, with the thickness t at a peripheral wall and a bottom wall thereof being 10 mm.

The billet 1 was placed into a stainless steel case, and the case was placed into an electric furnace. Then, the green compact 2 was subjected to a thermal treatment while permitting an Ar gas to flow in the case. The conditions for the thermal treatment were set at a heating temperature of 240° C. and a retention time of 100 minutes as in FIG. 2*e*. The structure relaxation phenomenon of the green compact 2 was substantially completed by this thermal treatment. After heating, the billet 1 was removed from the electric furnace and was cooled by air.

The billet 1 at a room temperature was placed, with its bottom wall located forwardly in an extruding direction, into a container of a hot extruder, where the green compact 2 was heated for about 5 minutes through the container. The extrusion was then immediately started. Immediately after being passed through a die, the resulting bar-like structural member was cooled by He gas. The specification of the hot extruder was such that the inside diameter of the container was 80 mm; the pressing force was 500 tons; and the diameter of the die bore was 22 mm.

Table I shows the relationship between the working conditions for a plurality of billets I to IX and the volume fraction Vf of the amorphous phase in each of the structural members. In Table I, the extrusion temperature (temperature at the start of working) was the temperature of the billet and thus of the green compact at the start of the extrusion. The container temperature was set 5° C. higher than that of the green compact.

TABLE I

| Billet No. | Working condition Ex. Tem. (°C.) | Ex. Ra. (mm/sec) | Ex. Pre. (ton) | Volume fraction Vf (%) of amorphous phase in structural member |
|---|---|---|---|---|
| I | 250 | — | — | — |
| II | 260 | 0.1 | 480 | ≧90 |
| III | 265 | 0.1 | 440 | ≧90 |
| IV | 265 | 0.5 | 470 | 60 |
| V | 265 | 3.0 | — | — |
| VI | 270 | 0.1 | 390 | 70 |
| VII | 270 | 0.5 | 410 | 50 |
| VIII | 270 | 3.0 | 490 | 15 |
| IX | 280 | — | — | — |

Ex. Tem. = Extrusion temperature
Ex. Ra. = Extrusion rate
Ex. Pre. = Extrusion pressure As apparent from the billets II to IV, VI and VII in Table I, if the extrusion temperature is set at a level between the glass transition temperature Tg (255.3° C.) and the crystallization temperature Tx (276.6° C.) and the extrusion rate is set in a range of 0.1 to 0.5 mm/sec., an amorphous alloy structural member having an amorphous phase volume fraction of 50% or more can be provided.

This is attributable to the fact that the structure relaxation phenomenon for the green compact 2 is substantially completed by the thermal treatment, the green compact 2 exhibits a relatively large elongation during hot extrusion, and the elongation is balanced with the extrusion rate.

The tensile test carried out for the structural member produced from the billet II showed that the tensile strength ($\sigma_B$) thereof was as high as 102.1 kg f/mm$^2$.

For the billets I, V and IX, extrusion was impossible. This is because, for billet I, the green compact 2 was not plasticized due to the extrusion temperature lower than the glass transition temperature Tg; for billet V, the elongation was unbalanced with the extrusion rate; and further, for billet IX, the crystallization of the green compact 2 proceeded due to the extrusion temperature higher than the crystallization temperature Tx.

For billet VIII, extrusion was possible, but the temperature of the billet was raised by the heat of friction caused between the die and the billet due to the high extrusion temperature and the high extrusion rate, with the result that the crystallization proceeded to make the volume fraction of the amorphous phase in the structural member low.

For comparison, a plurality of billets having the same configuration as those described above were produced and subjected to a hot extrusion under the same conditions as those described above, but without the thermal treatment.

Table II shows the working conditions and results of working for the billets X to XIV.

TABLE II

| Billet No. | Working condition Ex. Tem. (°C.) | Ex. Ra. (mm/sec) | Ex. Pre. (ton) | Volume fraction Vf (%) of amorphous phase in structural member |
|---|---|---|---|---|
| X | 250 | — | — | — |
| XI | 260 | — | — | — |
| XII | 265 | — | — | — |
| XIII | 270 | 0.1 | 440 | 30 |
| XIV | 280 | — | — | — |

Ex. Tem. = Extrusion temperature
Ex. Ra. = Extrusion rate
Ex. Pre. = Extrusion pressure As apparent from Table II, the structural member produced from billet XIII had a low volume fraction Vf of an amorphous phase and had a portion which could not be extruded. For the other billets, extrusion was impossible, particularly for billets XI and XII, structural members could not be produced therefrom even under the same extrusion conditions as those for the billets II to IV.

In the above-described producing process, the green compact that has been subjected to the thermal treatment may be placed into the container of the hot extruder while it is still heated from the thermal treatment.

During the thermal treatment, the temperature of the green compact can be raised to a temperature range between the glass transition temperature Tg and the crystallization temperature Tx by utilizing the exothermic phenomenon to complete the structure relaxation phenomenon swiftly.

What is claimed is:

1. A process for producing a structural member of an amorphous alloy, comprising the steps of:

subjecting a material formed from an amorphous alloy having a glass transition temperature Tg and a crystallization temperature Tx, which is higher than the glass transition temperature Tg, to a thermal treatment in which said material is kept at a heating temperature equal to or lower than the glass transition temperature Tg, thereby permitting a structure relaxation phenomenon to occur in said material; and subjecting said material to a hot plastic working while setting the temperature of said material at the time of starting the working to a level equal to or lower than the crystallization temperature Tx.

2. A process for producing a structural member of an amorphous alloy according to claim 1, wherein during said thermal treatment step, said structure relaxation phenomenon is sustained until said material assumes a state similar to a state provided when said material is heated to a temperature range between the glass transition temperature Tg and the crystallization temperature Tx.

3. A process for producing a structural member of an amorphous alloy according to claim 1, wherein said temperature of the material at the time of starting the hot plastic working is determined by the point where a differential scanning calorimeter analysis of said material indicates a negative value.

4. A process for producing a structural member of an amorphous alloy according to claim 1, wherein said material is subjected to said thermal treatment until the structure relaxation phenomenon has substantially been completed.

* * * * *